US007285900B2

(12) United States Patent
Yang et al.

(10) Patent No.: US 7,285,900 B2
(45) Date of Patent: Oct. 23, 2007

(54) FIELD EMISSION DISPLAY HAVING SELF-ADHESIVE FRAME

(75) Inventors: Frank Yang, Taipei (TW); Guo-Hua Chen, Taipei (TW); Jin-Shou Fang, Taipei (TW); Kuei-Wen Cheng, Taipei (TW)

(73) Assignee: Teco Nanotech Co., Ltd., Taipei (TW)

( * ) Notice: Subject to any disclaimer, the term of this patent is extended or adjusted under 35 U.S.C. 154(b) by 357 days.

(21) Appl. No.: 10/689,686

(22) Filed: Oct. 22, 2003

(65) Prior Publication Data

US 2005/0088072 A1 Apr. 28, 2005

(51) Int. Cl.
*H01J 29/86* (2006.01)
*H01J 9/26* (2006.01)

(52) U.S. Cl. ..... 313/495; 313/238; 313/292; 445/24; 445/25

(58) Field of Classification Search ..... 313/493, 313/495
See application file for complete search history.

(56) References Cited

U.S. PATENT DOCUMENTS 5,852,484 A * 12/1998 Inoue et al. ..... 349/86
6,036,567 A * 3/2000 Watkins ..... 445/25
6,583,552 B1 * 6/2003 Koyama ..... 313/495
6,612,888 B1 * 9/2003 Pai et al. ..... 445/24
6,847,355 B1 * 1/2005 Nishikawa et al. ..... 345/173
2004/0124760 A1 * 7/2004 Pothoven et al. ..... 313/493
2005/0264861 A1 * 12/2005 Enomoto et al. ..... 359/224

FOREIGN PATENT DOCUMENTS

JP 2000251767 A * 9/2000
JP 2002184329 A * 6/2002
JP 2003123673 A * 4/2003

* cited by examiner

*Primary Examiner*—Sikha Roy
(74) *Attorney, Agent, or Firm*—Rosenberg, Klein & Lee

(57) ABSTRACT

A self-adhesive frame is applied in package of field emission display, the manufacturing method for the same and the package method by the same being also discussed in the specification. The self-adhesive frame can be designed as an independent component and suitable to be manufactured independently. The cathode plate and the anode plate do not need to join the process of pre-heating of the self-adhesive frame. The self adhesive frame also has a plurality of fixing side strips for alignment of temporary fixing of the cathode plate and the anode plate. Wherein the fixing side strips do not increase the void area of the field emission display. The self-adhesive frame comprises: a main body frame having the cathode plate sealing surface and the anode plate sealing surface; and a fixing side strip extending from the outer side of the main body frame.

12 Claims, 6 Drawing Sheets

PRIOR ART 1

PRIOR ART 2

PRIOR ART 2

FIELD EMISSION DISPLAY HAVING SELF-ADHESIVE FRAME

FIELD OF THE INVENTION

The present invention relates to a self-adhesive frame applied in package of field emission display. Since the self-adhesive frame can be designed as an independent component and suitable to be manufactured independently, the cathode plate and the anode plate do not need to join the process of pre-heating of the self-adhesive frame. In addition, the self-adhesive frame also has a plurality of fixing side strips for alignment of temporary fixing of the cathode plate and the anode plate. Wherein the fixing side strips do not increase the void area of the field emission display. By using the self-adhesive frame the operator can applied the special package method to increase the operation convenience to improve the property such as the slanting magnitude and simplification of heating process for package of the field emission display.

BACKGROUND OF THE INVENTION

The kinds of flat panel display (FPD) includes field emission display (FED), liquid crystal display (LCD), plasma display panel (PDP), organic light emitter device (OLED), and liquid crystal projection display . . . etc. The common features of such display are thin and light weight. According to the property of every flat panel display, some of them can be applied on the small scale panel such as cellular phone, a little part of them being suitable to be applied on the medium or large scale device such as computer monitor or TV display, another application for them further comprising super large scale display device such as the outdoor digital exhibition board. But the technology of every kinds of the flat panel display all progress toward the object of high display quality together with large scale display and raising the duration life for application.

A new technology of carbon nanotube field emission display (CNT-FED) has the opportunity to have all the progressive property of the above-mentioned features. Please refer to the FIG. 1, the mentioned carbon nanotube field emission display is manufactured by the principle of field emission. Wherein the operation method is to apply the electrical field to induce the electrons from the tip of the electrical source 104 of the carbon nanotube. Applying the vacuum environment, the field emitting electrons can be pushed and forced by the positive voltage from the top base glass plate 100 having phosphors powder 102. Thus the electrons can accumulate its energy to strike the relative phosphors powder 102 to generate the light.

Thus from the above mentioned field emission display, the mentioned vacuum environment is established by the packaged of the cathode plate 122 and the anode plate 120 to draw out the air to form a vacuum region or a so-called package region 112. The vacuum degree in the vacuum sealing region is at least from $10^{-6}$ Torr to cause the residual air not interfering the field emission electrode. The vacuum degree should prevent the plasma generation to reduce the efficiency of light radiation and the reducing of duration life of the carbon nano tube.

Regarding the conventional art, for reaching the purpose of vacuum package, a kind of special glass glue with chemical bonding ability in high temperature is needed. The two process of high temperature treatment is required. The first treatment is called the pre-heating and by the temperature of 350 to 400 centigrade to oxidize the organic solvent in the glass glue. The second treatment is called fritting and by the temperature of 440 to 480 centigrade to cause the chemical bond for forming the larger molecules to ensure the sealing property and the connection strength. Thus the said glass material for chemical bond in the high temperature should have the property of certain bonding strength, no residue of volatile gas, low generation of dust. But during the heating process, the many internal material inside the cathode plate and the anode plate such as the electrical source 104 of the carbon nanotube, gas seal material and phosphors powder 102 should sustain two times of the process of high temperature. The high temperature may usually cause an effect to the property and quality of internal material. So the inventor think the problem how to reduce the times of high temperature treatment to the cathode plate and the anode plate to reduce the uncertainty factor to the property and quality of internal material.

The FIG. 1 shows the structure of the first prior art for a field emission display. It is generally to be divided into the cathode plate 122, the anode plate 120, vacuum sealing region 109 and the phosphors powder 102 deposited on the top base glass plate 100. The called anode plate 120 includes the phosphors powder 102 and the top base glass plate 100. The electrical source 104 of the carbon nanotube is deposited on the bottom base glass plate 110 to be used as electrical emitting source. The called cathode plate 122 includes the electrical source 104 of the carbon nanotube and the bottom base glass plate 110. The described prior art is requiring to apply the glass side strip 106 to keep a certain distance between the bottom base glass plate 110 and the top base glass plate 100 by the certain value of 0.5 mm to 2 mm. The alignment mark of the glass side strip 106 is marked by the photolithographic image or the laser process to decide the location of the glass side strip 106 on the bottom base glass plate 110 and the top base glass plate 100.

In the process of package, first step is to spread the glass glue 108 on the alignment marked location of top base glass plate 100 for the glass side strip 106, then the operator places the glass side strip 106 on the alignment marked location. Through the first pre-heating to fix the glass side strip 106 on the top base glass plate 100, the operator should spread the glass glue 108 on another surface of the fixed glass side strip 106 to proceed to one more pre-heating process to oxidize the organic solvent in the glass glue 108. The following step is to proceed to the temporary fixing by a kind of certain UV glue for the bonding of the bottom base glass plate 110 and the top base glass plate 100 through alignment. The purpose of the said temporary fixing is to keep the precision to prevent the distortion. The general application for temporary fixing is applied by the UV glue.

After the temporary fixing, the operator applies a kind of the fixing tool to fix the cathode plate 122 and the anode plate 120, proceeding to high temperature heat treatment as fritting. Thus the connection of the glass side strip 106 between the bottom base glass plate 110 and the top base glass plate 100 will be formed. But the UV glue will be decomposed in the high temperature treatment to pollute the glass glue. So the location of UV glue for the temporary fixing will be arranged as far as possible from the location of glass glue.

After the package of the bottom base glass plate 110 and the top base glass plate 100, the operator will proceed the vacuum pumping and sealing. Since the operation environment of the field emission display require the vacuum degree of $10^{-6}$ Torr, the operator will apply a kind of gas getter material as chemical pump to increase the efficiency of gas pumping and to catch the escaping air, the life of vacuum being extended by the said gas getter material. Sum up the prior art, though the art can reach the vacuum package, the remained problems is occurred such as hard control to distortion by the fixing tool at the period of heat treatment. This distortion is very hard to control between the cathode plate 122 and the anode plate 120.

Further, please refer to the other prior art as described in the FIG. 2 and FIG. 3. for the method of package. By using the photolithographic image or the laser process, the alignment mark can be added on the bottom base glass plate 110 and the top base glass plate 100. Then the respective heat treatment by high temperature will be applied by using the U shape glass side strip 206 fixed on the predetermined location of top base glass plate 100 and by using the U shape glass side strip 204 fixed on the predetermined location of bottom base glass plate 110. Then according to the alignment mark on the bottom base glass plate 110 and the top base glass plate 100, the operator can catch the precise alignment to proceed to temporary fixing. In addition, the groove 212 between the two U shape glass side strips 204,206 will be filled with the glass glue. This method of prior art can improve the distortion occurred in the conventional fixing method. The said distortion is caused by the nonuniform spreading of glass glue between the glass side strip 206 and the anode plate 120 to cause the displacement between the cathode plate 122 and the anode plate 120 to affect the alignment precision. This art can improve the distortion problem after the fritting of the cathode plate 122 and the anode plate 120. But the art still have some problems in need of solution.

1. The operation bottleneck is high.

(1) The fixing area of UV glue for temporary fixing is reduced.

The cathode plate 122 and the anode plate 120 should be applied temporary fixing after alignment. But the groove 212 between the two U shape glass side strip 204, 206 is for filling the glass glue. Thus the packing area and the sealing area for glass side strip 204, 206 are enlarged. This is just opposite to the requirement of common product that the effective area and picture area should be large and the void area and non-picture area should be small. This condition is also lead to the fixing area of UV glue for temporary fixing hard to be executed by lacking of void area.

(2) The times of alignment for package is increased together with the complexity of process being increased.

Since the U shape glass side strips 204,206 should be aligned and fixed on the cathode plate 122 and the anode plate 120 respectively, the cathode plate 122 and the anode plate 120 proceeding to align and to temporarily fix, the groove 212 between the two U shape glass side strips 204,206 being necessarily kept in a uniform distance, consequently the complexity and the hardness are increased.

(3) The process of glue spreading is more complex

The dimension of the two U shape glass side strips 204,206 are different. So the process of glue spreading are executed respectively. The additional process to spread glue in the groove 212 between the U shape glass side strips 204,206 is the third glue spreading process. Thus the complexity of process and the equipment cost are raised.

2. The times for the cathode plate 122 and the anode plate 120 to enter into the heat treatment device are increased Since the organic solvent of the glass glue should be oxidized, the pre-heating process is necessary after the spreading of the glass glue. But many kinds of material will be coated on the cathode plate 122, the anode plate 120 and the gas getter fixing region. These kinds of material have limited restriction to the high temperature process. Thus the more times of high temperature treatment will cause more restrictions to the selection of the coated material on the cathode plate 122 and the anode plate 120. The art described here will cause a more pre-heating and more fritting region. The risk of the manufacturing process is increased.

For the above mentioned, the inventor design a self-adhesive frame applied in package of field emission display to resolve the above mentioned problems. Please refer to the below description.

1. Raise the operation convenience (1). The present invention can provide a fixing side strip 402 for the UV glue to establish the temporary fixing. Further function can be shown in the fritting in high temperature by the reason of enough interfering distance between the UV glue and the glass glue 108. So the UV glue will not pollute the glass glue at the decomposition period to prevent the leakage of inner vacuum environment.

(2). The present invention can provide the function of reducing the accuracy requirement or complexity of the alignment.

(3). The present invention can apply the independent manufacturing. After the manufacturing process, the operator can introduce the independent component into the alignment process of the cathode plate 122 and the anode plate 120. Thus the glue spreading process can be reduced.

2. Reducing the times of heat treatment in high temperature for the cathode plate 122 and the anode 120.

The present invention can apply the temporary fixing to the cathode plate 122, the anode plate 120, and the gas getter to attach to a predetermined location from alignment. Thus the one time for heat treatment of fritting with pressing fixing is executed.

3. The distortion after the temporary fixing can be improved

The prior art easily generates the problem of nonuniform spreading of the high temperature glue. This condition will cause a displacement action between the cathode plate 122 and the anode plate 120. Thus, the glass glue will generate a slipping condition during the high temperature heat treatment. Whereas, the present invention has a high uniformity at the package surface that can overcome the problem of nonuniform high spreading of the high temperature glue.

SUMMARY OF THE INVENTION

From the second prior art having the function to resolve the shortage of the first prior art. But the second prior art still generate the problem of hard operation convenience and too small in picture area. The inventor then designs a kind of a self-adhesive frame having the benefit of high operation convenience together with large region of picture area. In addition, the cathode plate 122 and the anode plate 120 only require one time of fritting process. The present invention contains many benefits.

The main purpose of the present invention is to provide a structure suitable to the current manufacture process and low operation cost to provide an effect of low cost with high quality. The present invention provides a self-adhesive frame to overcome the problem of an increasing void area and provides an effective usage of temporary fixing of the frame. In addition, provides a packaging process for the cathode plate 122 and the anode plate 120 to reduce the alignment error and the distortion that occurs in the fitting process.

The other purpose of the present invention is to provide a manufacturing method for a self-adhesive frame. From the method can define the self-adhesive frame as a single package component. The self-adhesive frame can be independently manufactured away from the main production line. The pre-heating and the glue spreading on the cathode plate 122 and the anode plate 120 can be avoided. The present invention can reach the effect of reliability and clean level.

The extra purpose of the present invention is to provide a package method by applying the self-adhesive frame to the area of field emission display. The method can simplify the conventional alignment method of the cathode plate 122 and the anode plate 120 and reduce the times of heat treatment in package. Thus the shortage of heat treatment of high temperature can be reduced to prevent to reach the restriction of the coating material to extend the application range of the coating material.

From the above mentioned many purpose, the inventor provide a kind of self-adhesive frame and the package method by the same, from the present invention gathering many benefits for application. In addition, many other benefits can be clearly found after the skilled person having referred to the attached figures and the below description.

The present invention comprises: a main body frame having the cathode plate sealing surface and the anode plate sealing surface; and a fixing side strip extending from the outer side of the main body frame; wherein the cathode plate sealing surface and the anode plate sealing surface have been spread a coating of glass glue, the self-adhesive frame being treated by a heat treatment in high temperature; wherein the fixing side strip has a predetermined glue spreading area for the temporary fixing with the cathode plate 122 and the anode plate 120.

The various objects and advantages of the present invention will be more readily understood from the following detailed description when read in conjunction with the appended drawing, in which:

DETAILED DESCRIPTION OF THE INVENTION

Figure 1:
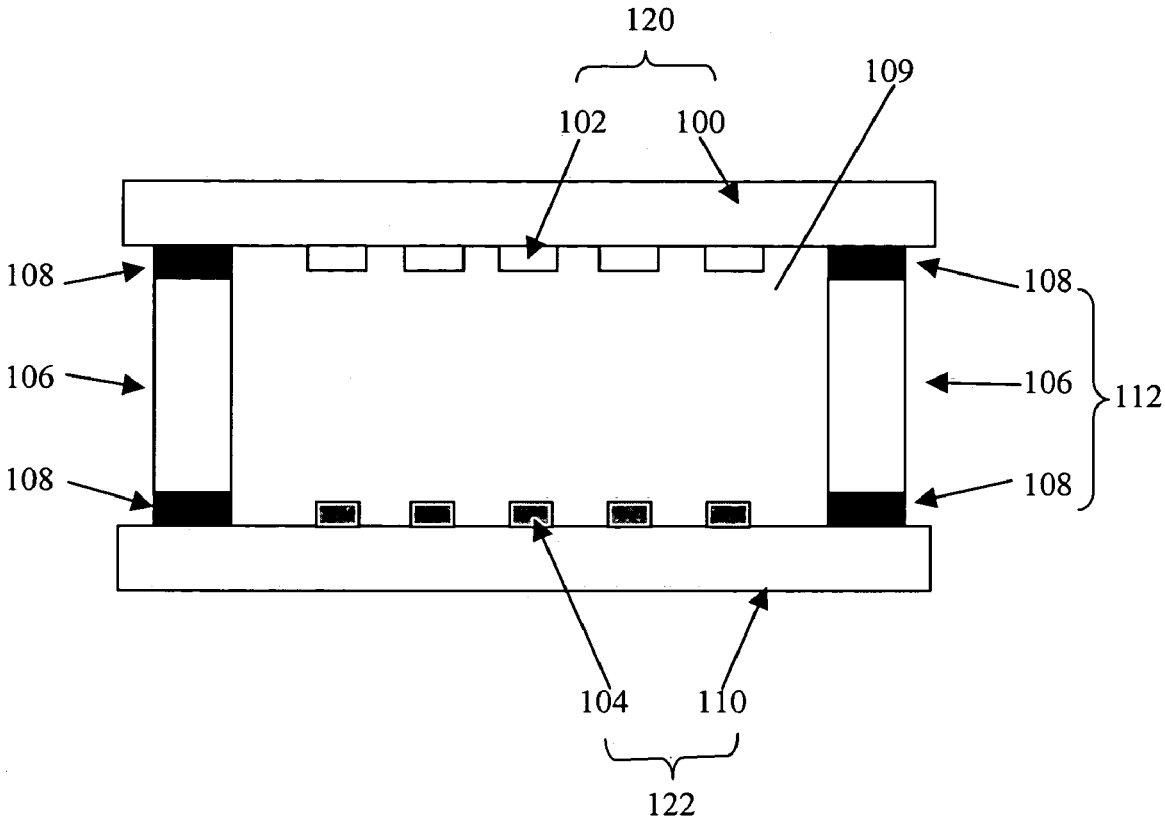
FIG. 1 shows a schematic sectional view of the package structure of a first prior art for the field emission display.
Figure 2:
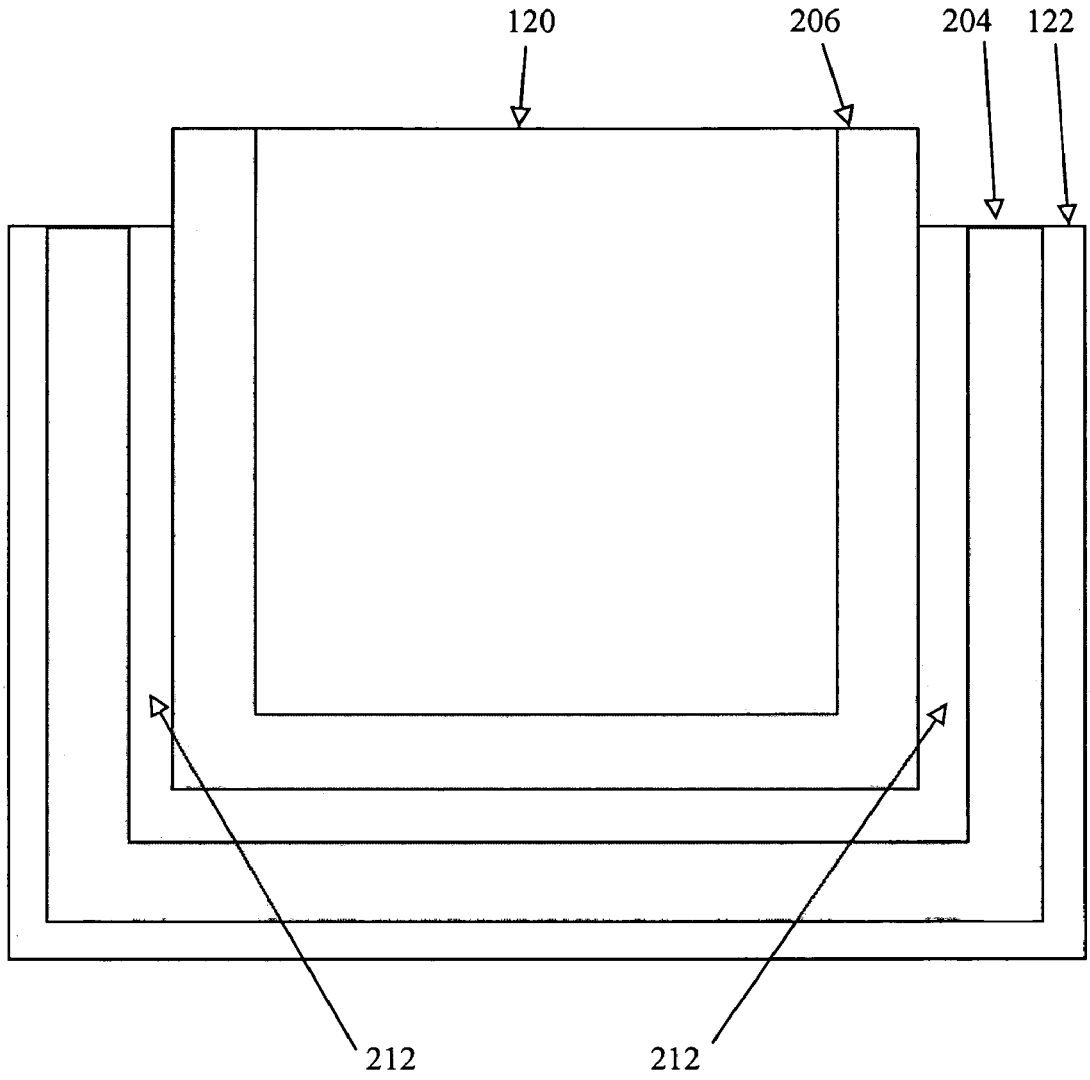
FIG. 2 shows a schematic top view of the package structure of a second prior art for field emission display.
Figure 3:
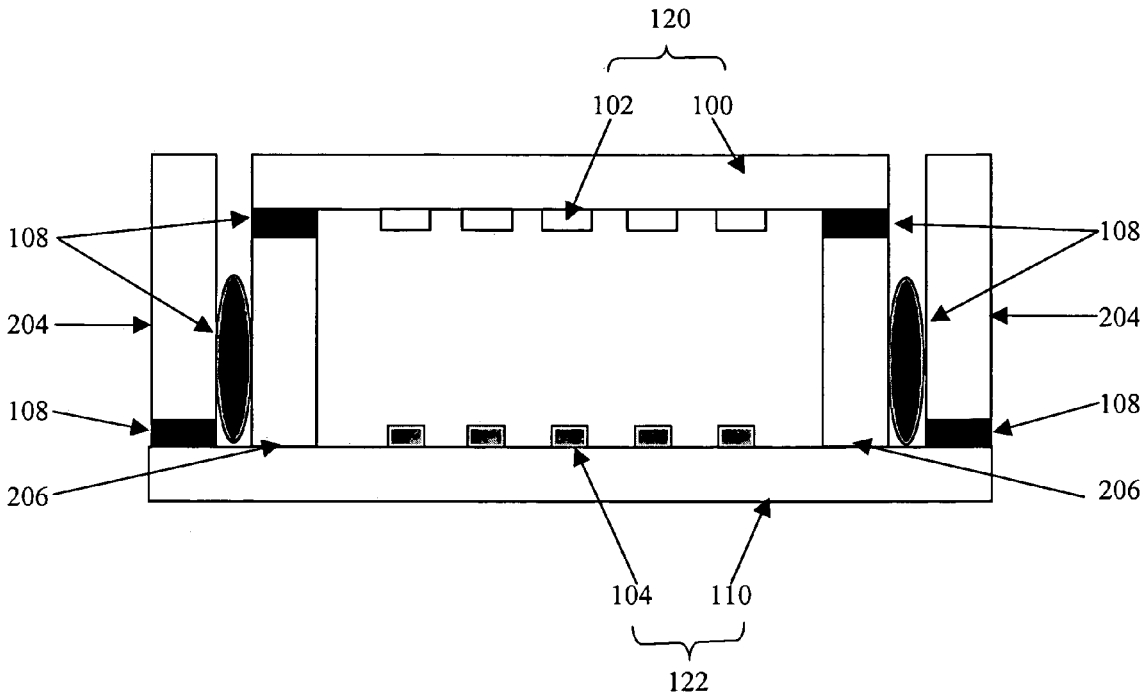
FIG. 3 shows a schematic sectional view of the package structure of a second prior art for field emission display.
Figure 4:
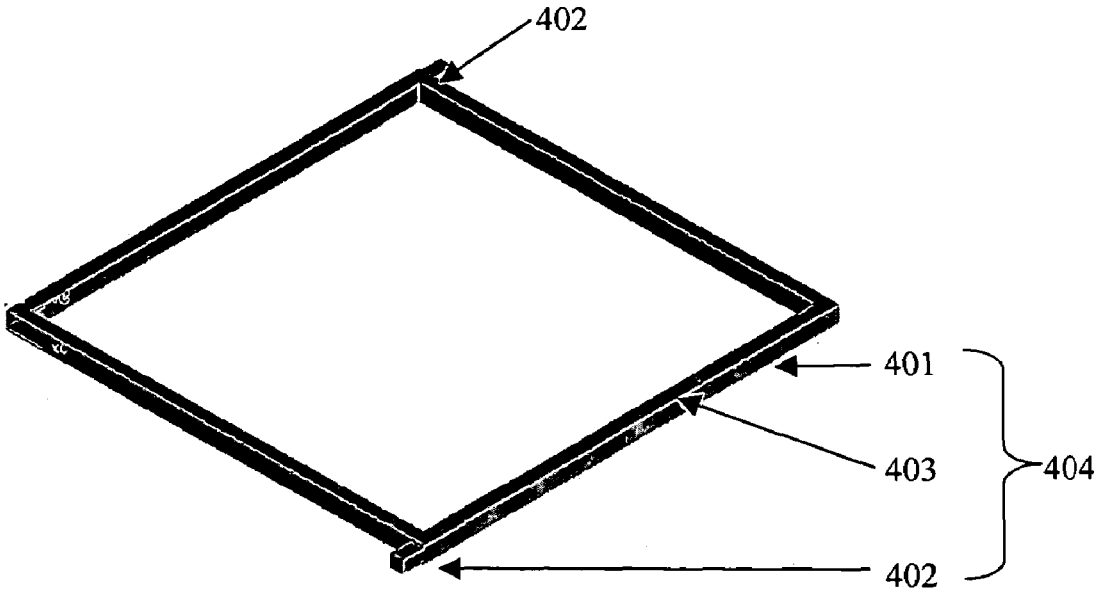
FIG. 4 shows a schematic view of a self-adhesive frame of the present invention by the three dimensional view to show the structure.
Figure 5:
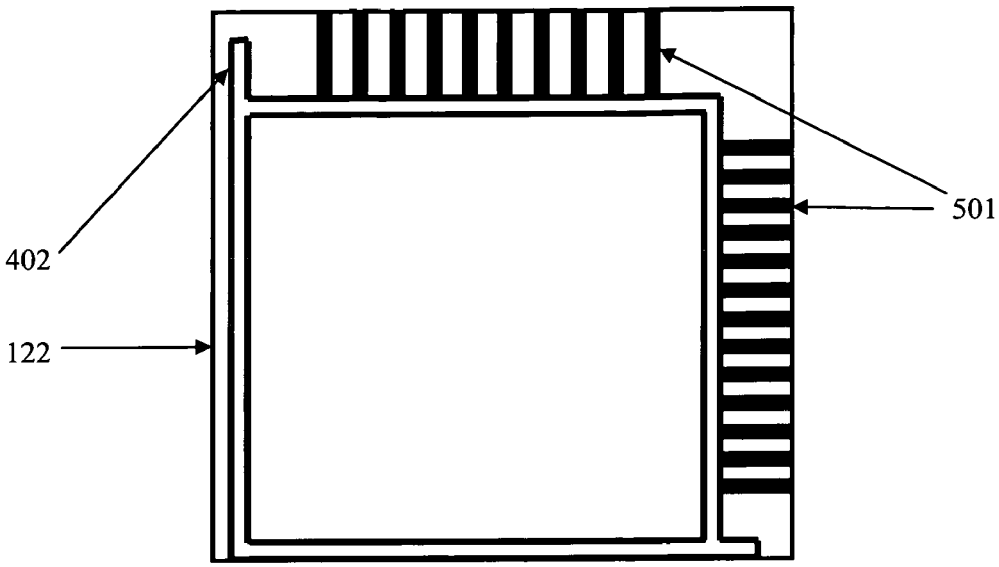
FIG. 5 shows a schematic top view of the relative position of a self-adhesive frame with respect to the cathode plate of the present invention.
Figure 6:
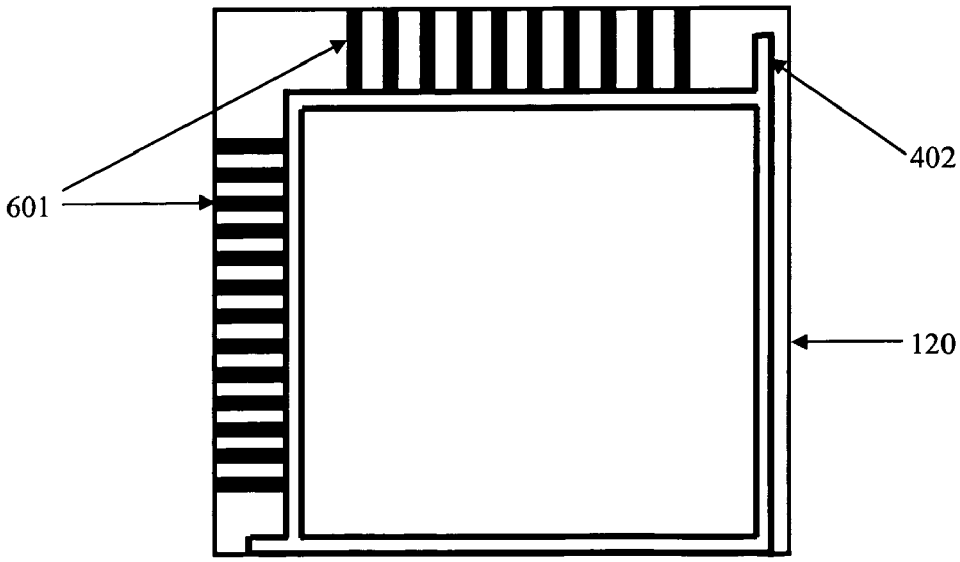
FIG. 6 shows a schematic top view of the relative position of a self-adhesive frame with respect to the anode plate of the present invention.

Please refer to the FIG. 4 for the structure overview of a self-adhesive frame 404 of the present invention. By reviewing from the second prior art, the inventor recognized that the U shape glass side strip is applied for resolving the problem of large distortion occurred in the prior art and still generate a lot of problems from the improvement of the second prior art. The inventor then decides to design the self-adhesive frame 404 that it has the benefit of reducing the distortion together with raising the operation convenience. Additionally, the present invention can also execute one time of fritting process by applying the self-adhesive frame 404 temporarily fixing with the cathode plate 122 and the anode plate 120. The present invention does not have the shortage of U shape glass side strip that it is hard to be temporarily fixed, complex process of glue spreading, and many times of heat treatment by high temperature.

The said self-adhesive frame 404 has its own structure and manufacturing method being shown in the FIG. 4 to FIG. 7. The self-adhesive frame 404 has a main body frame 401 in rectangular shape, a plurality of fixing side strip 402 extending from the side of the self-adhesive frame 404 for the spread location by the UV glue for the temporary fixing. Additionally, the fixing side strips 402 have a principle for location arrangement of not adding the void area of the display. Thus the inventor places one fixing side strip 402 at the location parallel to the cathode conductor 501 and the fixing side strip 402 is placed at the same side of the cathode conductor 501 with the specific length of the fixing side strip 402 less than the cathode conductor 501. Also another fixing side strip 402 is placed at the location parallel to the anode conductor 601 and the fixing side strip 402 is placed at the same side of the anode conductor 601 with the specific length of the fixing side strip 402 less than the anode conductor 601. The first glue spreading operation is that the main body frame 401 is spread the necessary glass glue 403 on the surface of the cathode plate sealing surface and the anode plate sealing surface. The said first glue spreading operation can be executed independently without cooperation with the cathode plate 122 and the anode plate 120. Thus the very easy method can be applied into the first glue spreading operation such as screen printing or glue dropping device to drop the glass glue 403 on proper position. Thus the planarization on the spreading surface can be reached by a simple extra work. To proceed to the next step is to put the above worked article into pre-heating treatment by 380 Centigrade to fully oxidize the organic solvent in the glass glue 403. Then the self-adhesive frame 404 can be produced from the above steps.

Figure 7:
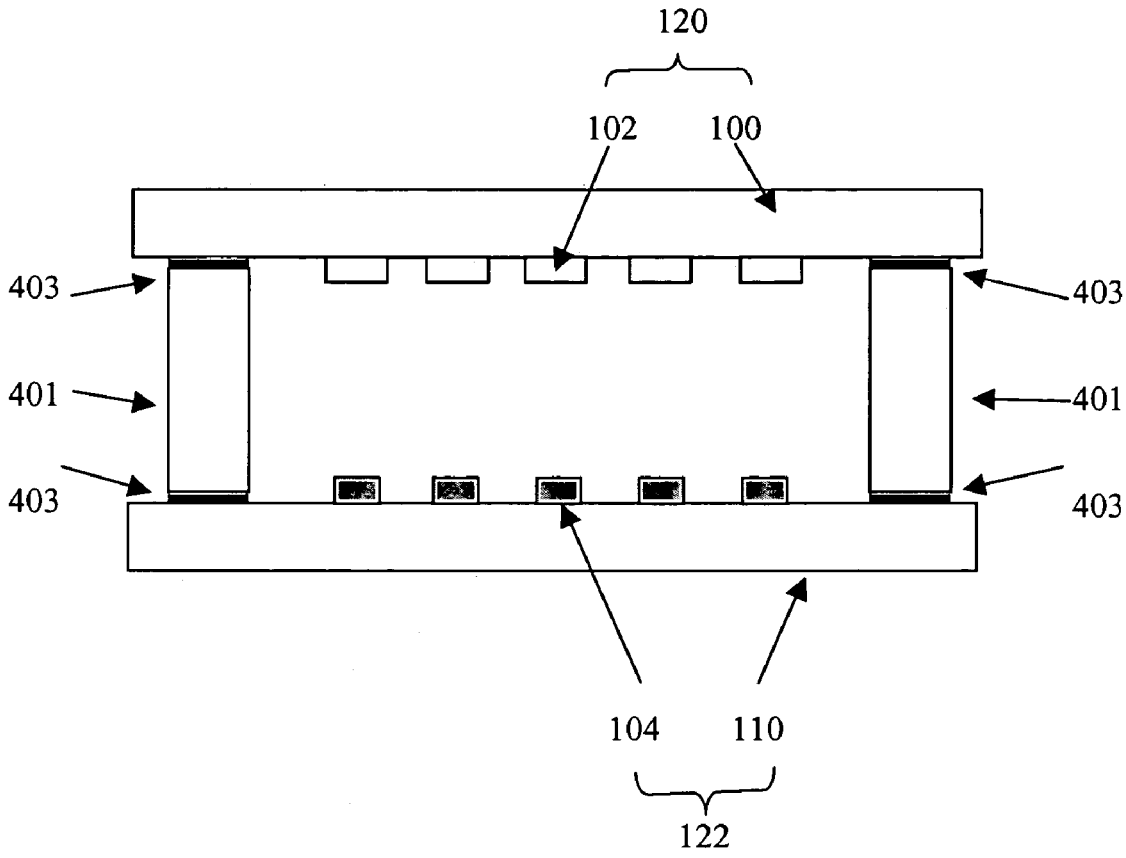
FIG. 7 shows a schematic sectional view of the package structure of the present invention for field emission display.

Base on the features of the self-adhesive frame 404, hereby provide a practical embodiment of package method by using the self-adhesive frame 404 on the field of field emission display. Firstly make alignment mark on the cathode plate 122 and the anode plate 120 and the mark is relative to the self-adhesive frame 404, the marked condition being general shown as the FIG. 5 and FIG. 6 described. Then spreading the UV glue on the sealing surfaces of fixing side strip 402, the sealing surface including the surface relative to the cathode plate 122 and the anode plate 120. Through a process of alignment action, the operator can easily install the self-adhesive frame 404 on the alignment mark of the cathode plate 122 and the anode plate 120 to cooperate with the UV source to solidify the UV glue to finish the temporary fixing process. Since the self-adhesive frame 404 is coated on certain surface by a glass glue 403 through heat treatment, the structure of temporary fixing process with the cathode plate 122 and the anode plate 120 can cooperate with a clipping device to be put into the heating stove. The stove can provide heating temperature of 460 centigrade to melt the glass glue 403. From the special pre-treatment of planarization on the self-adhesive frame 404, the coating layer of glass glue 403 can obviously reduce the distortion during fritting. Please refer to the FIG. 7 for the sectional structure of the present invention. Wherein the sealing face in FIG. 7 is smaller than the sealing face in the second prior art. The present invention can greatly reduce the void region and raise the utilization of picture area. In addition, the location of temporary fixing can be arranged at the side of the cathode conductor 501 or the side of the anode conductor 601 to simply the consideration of location of the temporary fixing.

The structure of the self-adhesive frame 404 of the present invention should be described here and it comprises: a main body frame 401 having the cathode plate sealing surface and the anode plate sealing surface; and a fixing side strip 402 extending from the outer side of the main body frame 401. Wherein the cathode plate sealing surface and the anode plate sealing surface have been spread a coating of glass glue 403, the self-adhesive frame 404 being treated by a heat treatment in high temperature. Wherein the fixing side strip 402 has a predetermined glue spreading area for the temporary fixing with the cathode plated 122 and the anode plate 120. Wherein the cathode plate sealing surface and the anode plate sealing surface are the top surface and bottom surface of the main body frame 401.

The variation of self-adhesive frame 404 will be described in the below. At the condition of temporary fixing, the self-adhesive frame 404 mates with the cathode plate 122 and the anode plate 120 in the position relationship that the fixing side strip is located at the same side of the cathode conductor 501 or the anode conductor 601. In addition, the shape of the main body frame can be design as rectangular. In general, the cathode plate sealing surface and the anode plate sealing surface are parallel mutually for the operation of field emission display. For low cost and convenience, the spreading action of glass glue 403 to the cathode plate sealing surface and the anode plate sealing surface can be by screen printing.

The manufacturing method of self-adhesive frame 404 applied in package of field emission display in the present invention, which comprise the steps of: (1) manufacturing a main body frame 401 and at least a fixing side strip 402; wherein the main body frame 401 has the cathode plate sealing surface and the anode plate sealing surface; wherein the fixing side strip 402 extending from the outer side of the main body frame 401; (2) by screen printing or glue dropping device to spread the glass glue 403 on proper positions of the cathode plate sealing surface and the anode plate sealing surface, by using the planar working to cause the planarization of the spread surface of the proper positions; (3) heating the semi manufactured article in (2) as 350-400 centigrade to cause the oxidization of organic solvent in the glass glue 403 to finish the self-adhesive frame.

The package method for field emission display using the self-adhesive frame 404 of the present invention, which comprising the steps of: (1). firstly making alignment marks on a cathode plate 122 and a anode plate 120 respectively for positioning of the self-adhesive frame 404; (2). secondly spreading the UV glue on the sealing surface of the cathode plate 122 and the sealing surface of the anode plate 120 of the fixing side strip 402 of the self-adhesive frame 404; (3). by an alignment process to fix the self-adhesive frame 404 on the location of alignment marks of the cathode plate 122 and the anode plate 120; (4). using the UV source to irradiate on the location of UV glue to solidify the UV glue to finish a temporary fixing; (5). applying a clipping device on the article of temporary fixing in (4) to proceed to send the article of temporary fixing into a stove to use 420 to 500 centigrade to melt the glass glue 403, finished the package.

From the above mentioned, we can recognize the features of the self-adhesive frame 404. Especially using the package method on the field emission display can obviously promote the yield rate and reduce the difficulty of manufacturing. The various benefits are from the features of the invention.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

We claim:

1. A field emission display having a self-adhesive frame comprising:

a cathode plate having a plurality of cathode conductors disposed thereon;

an anode plate having a plurality of anode conductors disposed thereon, said anode plate being disposed in spaced overlaying relationship with respect to said cathode plate; and, a frame disposed between said cathode and anode plates and having an enclosed space formed internal to said frame between said cathode and anode plates, said frame including:

a main body having a closed contour to define said enclosed space, said closed contour including two pairs of opposing mutually parallel sides, one of said sides being aligned along said plurality of cathode conductors and one of said sides being aligned along said plurality of anode conductors, said main body having a cathode plate sealing surface and an opposing anode plate sealing surface;

a first adhesive disposed on said cathode plate sealing surface and said anode plate sealing surface and sealing said enclosed space responsive to an application of heat thereto;

a plurality of fixing side strips extending from respective corners of and parallel to a corresponding one of said sides of the main body, each of said fixing side strips having a cathode plate facing surface and an anode plate facing surface, said cathode plate facing surface and said anode plate facing surface of said fixing strips continuously contacting each of said cathode and anode plates and maintaining said cathode and anode plates in registration prior to said application of heat; and a second adhesive disposed on said cathode plate facing surface and said anode plate facing surface of each of said fixing side strips, said second adhesive bonding said fixing strips to said cathode and anode plates to maintain said frame via light activation.

2. The field emission display as claimed in claim 1, wherein said main body has a rectangular contour.

3. The field emission display as claimed in claim 1, wherein the cathode plate sealing surface and the anode plate sealing surface are parallel mutually.

4. The field emission display as claimed in claim 1, wherein said first adhesive is a glass glue, said glass glue being heated within a range of 420° to 500° C. to seal said enclosed space.

5. The field emission display as claimed in claim 1, wherein a first of said plurality of fixing side strips extends in parallel relationship with said cathode conductors and a second of said plurality of fixing side strips extends in parallel relationship with said anode conductors.

6. The field emission display as claimed in claim 1, wherein the fixing side strips extend outwardly from two sides of the main body to reduce void area.

7. The field emission display as claimed in claim 1, wherein there are at least two fixing side strips which extend vertically from the end of two adjacent sides.

8. A self-adhesive frame for spacing cathode and anode plates of a field emission display in a separate manufacturing process comprising:

a main body separating the cathode and anode plates and having a closed contour, said main body having a cathode plate sealing surface and an opposing anode plate sealing surface;

a glass adhesive disposed in a dried un-fused state on said cathode plate sealing surface and said anode plate sealing surface;

a plurality of fixing side strips extending outwardly from an outer side of the main body, each of said fixing side strips having a cathode plate facing surface and an anode plate facing surface, said cathode plate facing surface and said anode plate facing surface of the fixing strips continuously contacting each of said cathode plate and anode plate and maintaining said cathode and anode plates in registration;

a light-activated adhesive disposed in an un-activated state on said cathode plate facing surface and said anode plate facing surface of each of said fixing side strips;

activating the light-activated adhesive to fix the cathode and anode plates; and heating the cathode plate, anode plate, and main body, and further melting the glass adhesive to bond the cathode plate, anode plate and light-activated adhesive.

9. The field emission display as claimed in claim 8, wherein said main body has a rectangular contour.

10. The field emission display as claimed in claim 8, wherein the cathode plate sealing surface and the anode plate sealing surface are parallel mutually.

11. The field emission display as claimed in claim 8, wherein the fixing side strips extend outwardly from at least two sides of the main body to reduce void area space.

12. The field emission display as claimed in claim 8, wherein there are at least two fixing side strips that extend vertically from the end of two adjacent sides.

* * * * *